US006210256B1

(12) United States Patent
Chen et al.

(10) Patent No.: US 6,210,256 B1
(45) Date of Patent: Apr. 3, 2001

(54) CONTINUOUS PAD FEEDING METHOD FOR CHEMICAL-MECHANICAL POLISHING

(75) Inventors: Hsueh-Chung Chen, Yung-Ho; Wen-Cheng Yeh, Pao-Shan Hsiang; Ming-Sheng Yang, Hsin-Chu, all of (TW)

(73) Assignee: United Microelectronics Corp., Hsin-Chu (TW)

( * ) Notice: Subject to any disclaimer, the term of this patent is extended or adjusted under 35 U.S.C. 154(b) by 0 days.

(21) Appl. No.: 09/476,654

(22) Filed: Dec. 31, 1999

(51) Int. Cl.[7] ..... B24B 21/00

(52) U.S. Cl. ..... 451/53; 451/41; 451/59; 451/296; 451/307

(58) Field of Search ..... 451/41, 53, 54, 451/59, 296, 299, 168, 307, 309, 458

(56) References Cited

U.S. PATENT DOCUMENTS

| | | | | |
|---|---|---|---|---|
| 5,249,393 | * | 10/1993 | Judge et al. | 451/307 |
| 5,899,794 | * | 5/1999 | Shige et al. | 451/59 |
| 5,913,716 | * | 6/1999 | Mucci et al. | 451/59 |
| 6,120,359 | * | 9/2000 | Ohno et al. | 451/59 |

* cited by examiner

*Primary Examiner*—Eileen P. Morgan

(57) ABSTRACT

A continuous pad feeding method for chemical-mechanical polishing (CMP) is described, which method is suitable for use in a CMP apparatus. The CMP apparatus includes a first polishing belt having two terminals, which first polishing belt serves as a plurality of polishing pads. A second polishing belt having two terminals is provided on the first polishing belt. One of the terminals of the second polishing belt is adhered to one of the terminals of the first polishing belt.

18 Claims, 3 Drawing Sheets

CONTINUOUS PAD FEEDING METHOD FOR CHEMICAL-MECHANICAL POLISHING

BACKGROUND OF THE INVENTION

1. Field of the Invention

The present invention relates to a chemical mechanical polishing (CMP) apparatus, and particularly to a pad feeding method suitable for use in a CMP apparatus.

2. Description of the Prior Art

Semiconductor fabrication has reached the deep sub-micron stage. In the deep sub-micron stage, the feature size and the depth of focus (DOF) of photolithography equipment are reduced, and the number of multi-level metal interconnect layers is increased. Consequently, how to maintain a high degree of surface planarity for the wafer has become a major topic of investigation.

Before the deep sub-micron era of semiconductor production, spin-on-glass (SOG) was employed to be the principle method of planarizing a silicon wafer. However, the method obtains moderate planarity in only local areas on the wafer surface. Without a global planarization of the wafer surface, quality of development after photographic exposure is degraded and the etching end-point is difficult to determine. These disadvantages reduce the yield of the wafer, and this reduction is a reason why SOG is substituted by chemical-mechanical polishing (CMP).

After semiconductor fabrication reached the deep sub-micron regime, CMP apparatus becomes a necessary apparatus of globally planarizing a silicon wafer. However, the polishing pad for a chemical mechanical polisher is a consumptive element. That is, the polishing pad needs to be changed after hundreds of polishing processes are performed.

FIG. 1 is a schematic view showing a conventional pad feeding mechanism in a CMP apparatus. As shown in FIG. 1, the CMP apparatus has a polishing platen 102 and a wafer carrier 110, wherein the wafer carrier 110 can hold a wafer 104 downward to the polishing platen 102. A polishing belt 100, serving as a plurality of polishing pads, is applied for use in the pad feeding mechanism. When a polishing pad (a portion of the polishing belt 100) on the polishing platen 102 needs to be changed, a terminal of the polishing belt 100 is pulled to spread out another unpolished portion of the polishing belt 100 to cover the polishing platen 102.

Other portions of the polishing belt 100 are rolled for space consideration. However, when the roller-type polishing belt 100 are wholly consumed, the CMP apparatus should have a shutdown for replenishing a new polishing belt. Such replenishment is complicated and time-consuming. There is therefore a need to improve this conventional pad feeding mechanism.

SUMMARY OF THE INVENTION

In accordance with the present invention, a continuous pad feeding method for chemical-mechanical polishing (CMP) is disclosed. The method is suitable for use in a CMP apparatus, wherein the CMP apparatus includes a first polishing belt having two terminals. The first polishing belt serves as a plurality of polishing pads. A second polishing belt having two terminals is provided on the first polishing belt. One of the terminals of the second polishing belt is adhered to one of the terminals of the first polishing belt.

Preferably, the adhering step is performed as follows. A first adhesion is coated on a surface of the first polishing belt. A second adhesion is coated on a surface of the second polishing belt. The second polishing belt is put on the first polishing belt by aligning the surface of the first polishing belt with the surface of the second polishing belt.

The second polishing belt is put on the first polishing belt for replenishment, after the first polishing belt is almost wholly consumed. This replenishing mechanism saves the maintenance time and increases the throughput of the CMP apparatus.

BRIEF DESCRIPTION OF THE DRAWINGS

The foregoing aspects and many of the attendant advantages of this invention will become more readily appreciated as the same becomes better understood by referring to the following detailed description, when taken in conjunction with the accompanying drawings, wherein.

DESCRIPTION OF THE PREFERRED EMBODIMENT

Figure 1:
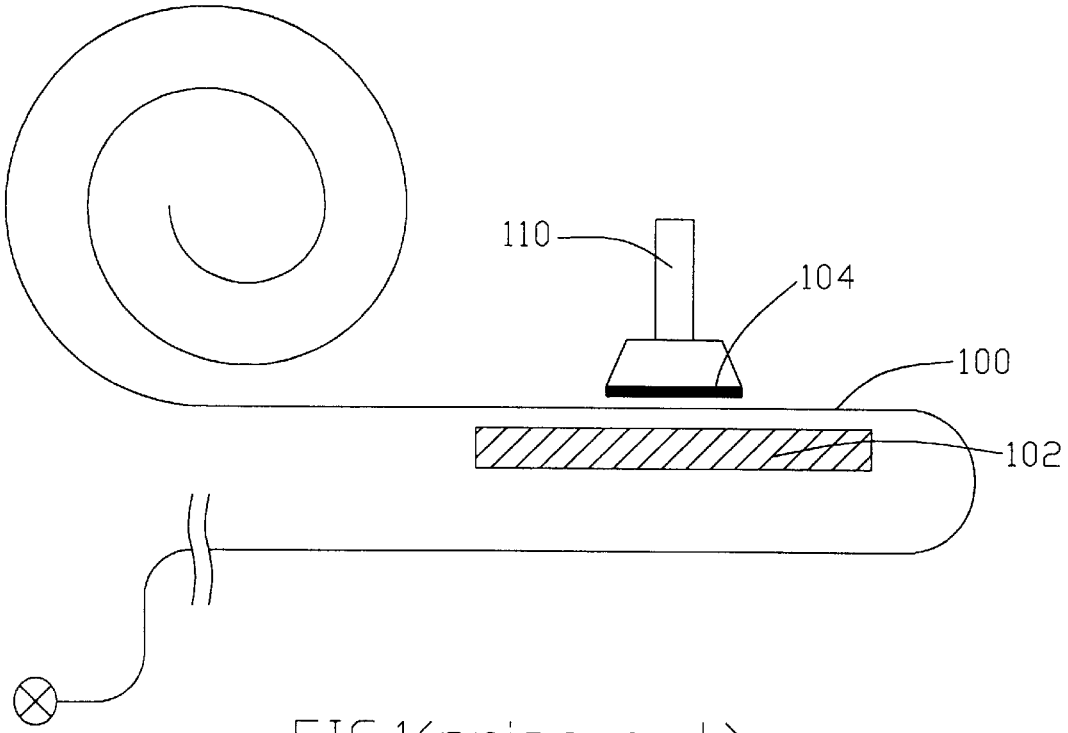
FIG.1(prior art)
FIG. 1 is a schematic view showing a conventional pad feeding mechanism in a CMP apparatus.
Figure 2:
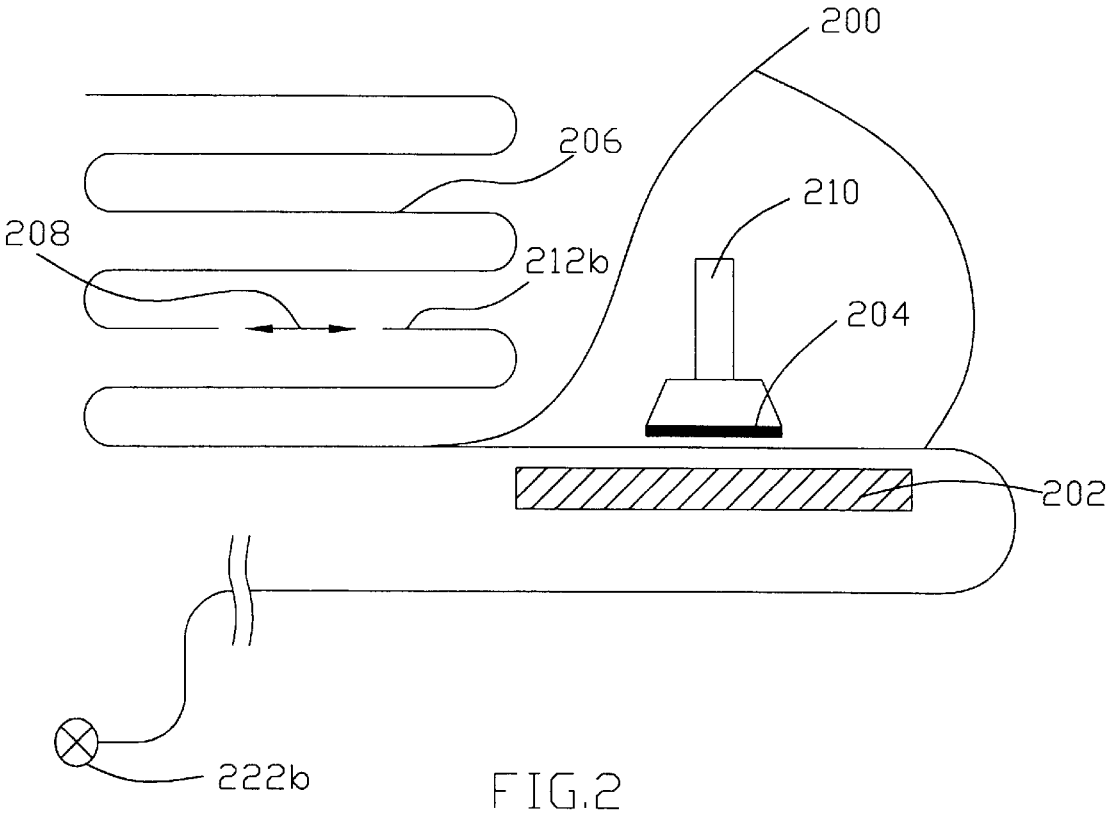
FIG. 2 is a schematic, cross-sectional view showing a chemical-mechanical polishing (CMP) apparatus and a pad feeding mechanism according to the present invention.

FIG. 2 is a schematic, cross-sectional view showing a chemical-mechanical polishing (CMP) apparatus and a pad feeding mechanism according to the present invention. As shown in FIG. 2, the CMP apparatus comprises a polishing platen 202 and a wafer carrier 210, wherein the wafer carrier 210 can hold a wafer 204 downward on the polishing platen 202.

A first polishing belt 200 with two terminals 212*b*, 222*b* serves as a plurality of polishing pads. After one of the terminals 222*b* is pulled, a portion of the first polishing belt 200 is spread out to cover the polishing platen 202. Another terminal 212*b* of the first polishing belt 200 can be adhered to a second polishing belt 206 by means of back adhesion or thermal-fluxing glue or other type of adhesion.

Figure 3A:
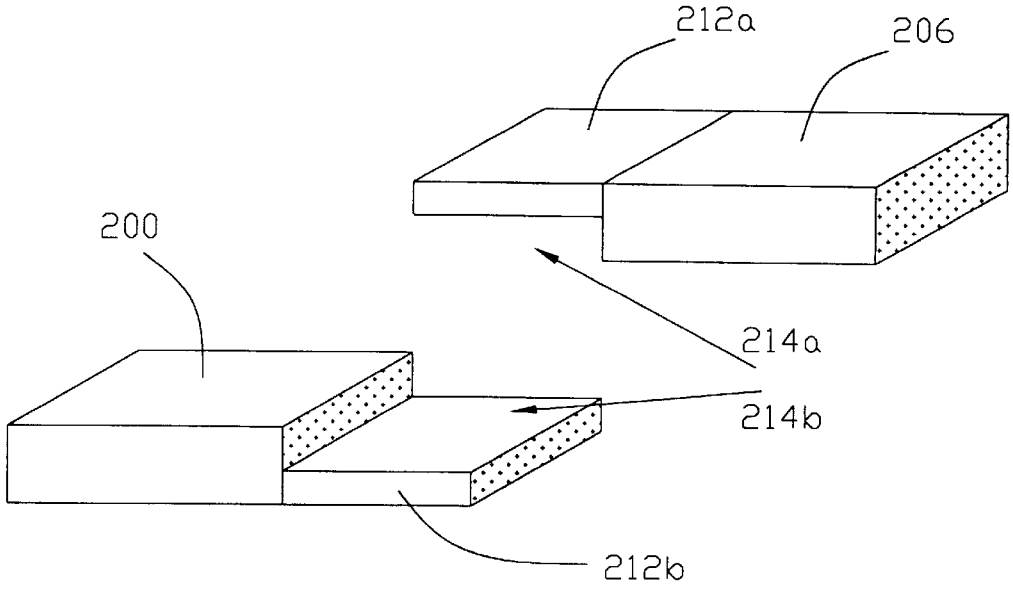
FIG. 3A shows the terminals for adhesion of the first and the second polishing belts.

Referring to FIG. 3A, the terminal 212*b* for adhesion of the first polishing belt 200 is substantially thinner than other parts of the first polishing belt 200. A first back adhesion, thermal-fluxing glue or other type of adhesion 214*b* is coated on the terminal 212*b* for adhesion of the first polishing belt. A second back adhesion, thermal-fluxing glue or other type of adhesion 214*a* is coated on a terminal 212*a* of the second polishing belt 206. The second adhesion 214*a* is coated on the back surface of the terminal 212*a* of the second polishing belt 206, while the first adhesion 214*b* is coated on the front surface of the terminal 212*b* the first polishing belt 200. By such arrangement, the second polishing belt 206 can be connected with the first polishing belt 200 by aligning the adhesion terminal 212*a* of the second polishing belt 206 with the adhesion terminal 212*b* of the first polishing belt 200.

Still referring to FIG. 3A, the adhesion terminal 212*b* of the second polishing belt 200 is also substantially thinner than other parts of the second polishing belt 200. After being connected with the first polishing belt 200, the adhesion terminal 212*a* of the second polishing belt 206 and the adhesion terminal 212*b* of the first polishing belt 200, in total, have a thickness which is substantially the same as that of the other parts of the first or the second polishing belts 200, 206. This thickness limitation benefits serving the adhesion terminals 212*a*, 212*b* as a polishing pad.

Figure 3B:
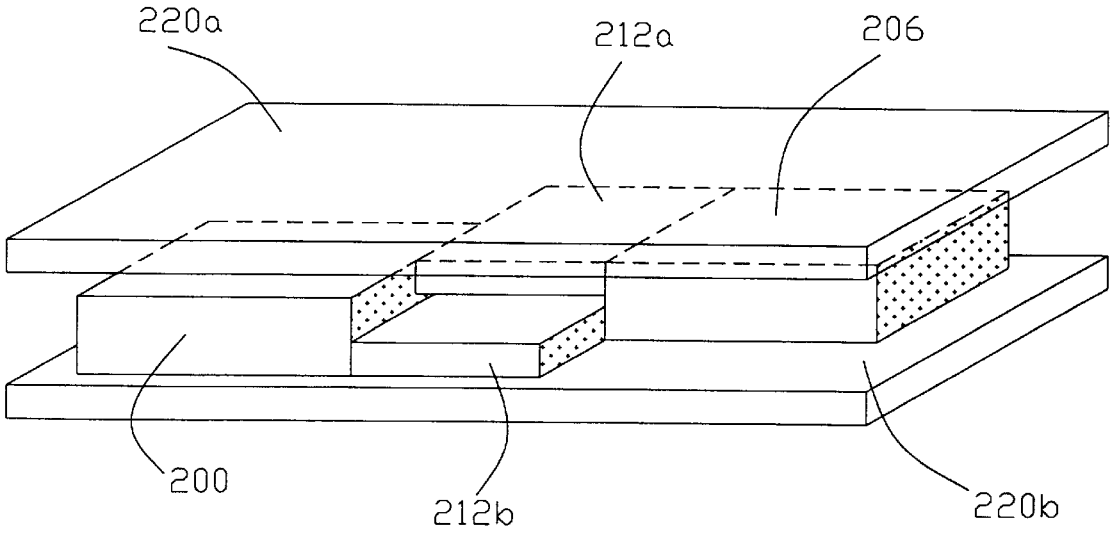
FIG. 3B is a schematic, cross-sectional view showing a thermal assembly for heating the thermal-fluxing glues.
Figure 4:
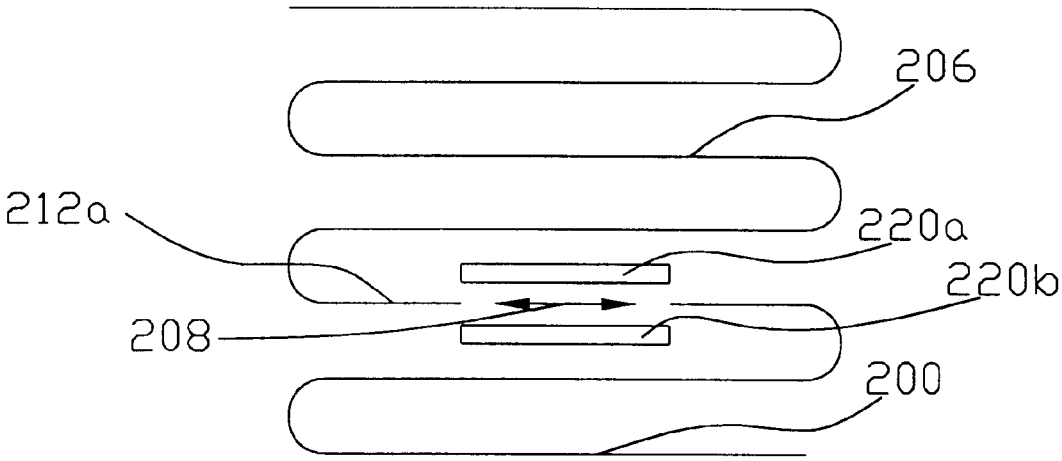
FIG. 4 shows the positions of the lower and the upper heating plates.

If the thermal-fluxing glues serve as the adhesions 214*a*, 214*b* between the first and the second polishing belt 200, 206, it is necessary to provide a thermal assembly for heating the glues. Referring to FIG. 3B and FIG. 4, this thermal assembly can be accomplished by locating a lower heating plate 220*b* beneath the connection position 208 and locating an upper heating plate 220*a* above the connection position 208.

Turning to FIG. 2, for space consideration or other purposes, the first polishing belt 200 and the second polishing belt 206 are folded up several times. It is not necessary to put the second polishing belt 206 on the first polishing belt 200 at all times. In fact, the second polishing belt 206 serves as replenishment. That is, the second polishing belt 206 is put on the first polishing belt 200 after the first polishing belt 200 is almost wholly consumed.

When the second polishing belt 206 is put on the first polishing belt 200, it is not necessary to have a shutdown of the CMP apparatus. In other words, this polishing-belt replenishment is independent from the operation of the CMP apparatus. As a result, applying this replenishing mechanism saves the maintenance time and increases the throughput of the CMP apparatus.

Although specific embodiments have been illustrated and described, it will be obvious to those skilled in the art that various modifications may be made without departing from the spirit which is intended to be limited solely by the appended claims.

What is claimed is:

1. A continuous pad feeding method for chemical-mechanical polishing (CMP), which method is suitable for use in a CMP apparatus, the CMP apparatus consumes a first polishing belt having two terminals, which first polishing belt is served as a plurality of polishing pads, the method comprises:

providing a second polishing belt having two terminals on the first polishing belt; and adhering one of the terminals of the second polishing belt to one of the terminals of the first polishing belt.

2. The method according to claim 1, wherein the adhering step is performed by the following steps:

coating a first adhesion on a surface of the first polishing belt;

coating a second adhesion on a surface of the second polishing belt; and putting the second polishing belt on the first polishing belt by aligning the surface of the first polishing belt with the surface of the second polishing belt.

3. The method according to claim 2, wherein the first and the second adhesions are thermal-fluxing glues.

4. The method according to claim 3, further comprises providing a thermal assembly for heating the thermal-fluxing glues.

5. The method according to claim 4, wherein the thermal assembly comprises a lower heating plate beneath the thermal-fluxing glues and comprises an upper heating plate above the thermal-fluxing glues.

6. The method according to claim 1, wherein the first and the second polishing belt are folded up.

7. The method according to claim 2, wherein the terminal coated with the first adhesion is substantially thinner than other parts of the first polishing belt.

8. The method according to claim 7, wherein the terminal coated with the second adhesion is substantially thinner than other parts of the second polishing belt.

9. The method according to claim 8, wherein the terminal coated with the first adhesion and the terminal coated with the second adhesion have a total thickness substantially the same as the other parts of the first and the second polishing belts.

10. A method of replenishing a polishing belt, which method is suitable for use in a CMP apparatus, the CMP apparatus consumes a first polishing belt having two terminals, the method comprises:

providing a second polishing belt having two terminals on the first polishing belt; and adhering one of the terminals of the second polishing belt to one of the terminals of the first polishing belt.

11. The method according to claim 10, wherein the adhering step is performed by the following steps:

coating a first adhesion on a surface of the first polishing belt;

coating a second adhesion on a surface of the second polishing belt; and putting the second polishing belt on the first polishing belt by aligning the surface of the first polishing belt with the surface of the second polishing belt.

12. The method according to claim 11, wherein the first and the second adhesions are thermal-fluxing glues.

13. The method according to claim 12, further comprises providing a thermal assembly for heating the thermal-fluxing glues.

14. The method according to claim 13, wherein the thermal assembly comprises a lower heating plate beneath the thermal-fluxing glues and comprises an upper heating plate above the thermal-fluxing glues.

15. The method according to claim 10, wherein the first and the second polishing belt are folded up.

16. The method according to claim 11, wherein the terminal coated with the first adhesion is substantially thinner than other parts of the first polishing belt.

17. The method according to claim 16, wherein the terminal coated with the second adhesion is substantially thinner than other parts of the second polishing belt.

18. The method according to claim 17, wherein the terminal coated with the first adhesion and the terminal coated with the second adhesion have a total thickness substantially the same as the other parts of the first and the second polishing belts.

* * * * *